US012024835B2

(12) United States Patent
Neusch

(10) Patent No.: US 12,024,835 B2
(45) Date of Patent: Jul. 2, 2024

(54) SUPPORTING BOLLARD PANELS DURING BOLLARD WALL INSTALLATION

(71) Applicant: Neusch Innovations, LP, Burnet, TX (US)

(72) Inventor: William H. Neusch, Marble Falls, TX (US)

( * ) Notice: Subject to any disclaimer, the term of this patent is extended or adjusted under 35 U.S.C. 154(b) by 0 days.

(21) Appl. No.: 18/497,722

(22) Filed: Oct. 30, 2023

(65) Prior Publication Data

US 2024/0125061 A1 Apr. 18, 2024

Related U.S. Application Data

(63) Continuation of application No. 29/857,615, filed on Oct. 24, 2022, and a continuation of application No. 17/300,312, filed on Dec. 31, 2020, now Pat. No. 11,802,386.

(51) Int. Cl.
*E01F 15/04* (2006.01)

(52) U.S. Cl.
CPC ..... *E01F 15/0461* (2013.01)

(58) Field of Classification Search
CPC . E04H 17/14; E04H 17/1413; E04H 17/1417; E04H 17/1426; E04H 17/143; E04H 17/16; E04H 17/164; E04H 17/17; E04H 17/20; E04H 17/22; E04H 17/23; E04H 17/263; E01F 15/0461; E01F 15/08
See application file for complete search history.

(56) References Cited

U.S. PATENT DOCUMENTS 1,271,751 A * 7/1918 Novess ..... E04H 17/009 52/150
2,849,202 A * 8/1958 McCombs ..... E04H 12/2238 248/524
3,817,006 A * 6/1974 Williams ..... E04G 21/26 248/354.3
4,930,752 A * 6/1990 Wolper, Jr. ..... E01F 15/025 256/45
5,862,637 A * 1/1999 Bruce ..... E04D 13/00 52/146
5,937,610 A * 8/1999 Behunin ..... E04G 21/202 52/745.1
6,782,668 B2 * 8/2004 Bruce ..... G09F 19/22 52/127.2
7,699,558 B2 * 4/2010 Adler ..... E01F 13/00 404/6
7,739,842 B1 * 6/2010 Hodsdon ..... E04G 21/26 52/645
7,850,391 B2 * 12/2010 Omar ..... E01F 13/12 404/6

(Continued)

FOREIGN PATENT DOCUMENTS

AU 2021104696 A4 * 9/2021
CN 104259344 A * 1/2015 ..... B21F 1/00

(Continued)

*Primary Examiner* — Jonathan P Masinick
(74) *Attorney, Agent, or Firm* — Bradley Arant Boult Cummings LLP; Henry L. Ehrlich

(57) ABSTRACT

A brace and method for supporting a bollard panel in a vertical position includes a linear structural member having a panel connector to secure adjacent bollard panels to the linear structural member.

20 Claims, 6 Drawing Sheets

(56) References Cited

U.S. PATENT DOCUMENTS

| | | | | |
|---|---|---|---|---|
| 8,015,759 | B1 * | 9/2011 | Bruce | G09F 7/18 52/25 |
| 8,322,106 | B2 * | 12/2012 | Simmons | E04H 12/2238 256/64 |
| 8,782,970 | B2 * | 7/2014 | Griffiths | E02D 5/74 52/153 |
| 9,422,734 | B1 * | 8/2016 | Heady | E04G 23/0229 |
| 9,446,932 | B2 * | 9/2016 | Nobles | E04H 12/347 |
| 10,006,220 | B2 * | 6/2018 | Lee | E04H 17/009 |
| 10,335,707 | B2 * | 7/2019 | Nunes | A63K 1/00 |
| 10,337,205 | B2 * | 7/2019 | Westfahl | E04H 17/23 |
| 10,427,916 | B1 * | 10/2019 | Fisher | B66C 23/36 |
| 10,633,887 | B1 * | 4/2020 | Fisher | E04H 17/263 |
| 10,689,819 | B2 * | 6/2020 | Neusch | E01F 15/0461 |
| 11,105,116 | B1 * | 8/2021 | Fisher | E04H 17/24 |
| 11,268,293 | B2 * | 3/2022 | Neusch | E04H 17/1439 |
| 2008/0308780 | A1 * | 12/2008 | Sloan | E04H 17/161 256/31 |
| 2019/0345732 | A1 * | 11/2019 | Wicks | E04H 17/08 |
| 2021/0222455 | A1 * | 7/2021 | Flores | E04H 17/009 |

FOREIGN PATENT DOCUMENTS

| | | | | | |
|---|---|---|---|---|---|
| CN | 115961536 | A | * | 4/2023 | |
| DE | 3712618 | A | * | 11/1988 | A63C 19/06 |
| DE | 102017126139 | A1 | * | 5/2019 | |
| GB | 2250038 | A | * | 5/1992 | E04H 17/22 |
| GB | 2564462 | A | * | 1/2019 | E04H 17/14 |
| KR | 100693067 | B1 | * | 3/2007 | |
| KR | 20140043185 | A | * | 4/2014 | |
| KR | 101489139 | B1 | * | 2/2015 | |
| WO | WO-2007112483 | A1 | * | 10/2007 | E04G 5/14 |

* cited by examiner

SUPPORTING BOLLARD PANELS DURING BOLLARD WALL INSTALLATION

BACKGROUND

This section provides background information to facilitate a better understanding of the various aspects of the disclosure. It should be understood that the statements in this section of this document are to be read in this light, and not as admissions of prior art.

Bollard fences or barriers are constructed of metal tubular members that are spaced laterally apart a sufficient distance to permit sight across the barrier and to allow water to pass through the barrier while preventing the passage of people through the gap. The bollards are often constructed of heavy steel pipe ranging in length from twenty to forty feet and more and which may be filled with material such as concrete. Erecting the bollards to form a lengthy barrier can be a tedious and time-consuming endeavor.

SUMMARY

An exemplary method for supporting adjacent bollard fence panels prior to the adjacent bollard panels being secured in the ground includes positioning a first bollard panel with a lower end in an excavation, the first bollard panel comprising first steel bollards arranged in a vertical plane, a first L-shaped member having a first vertical leg and first horizontal leg, the first vertical leg secured to each of the first steel bollards with a first end of the first L-shaped member extending outside of the first bollard panel, positioning a second bollard panel with a lower end in the excavation, the second bollard panel comprising second steel bollards arranged in the vertical plane, a second L-shaped member having a second vertical leg and second horizontal leg, the second vertical leg secured to each of the second steel bollards with a second end of the second L-shaped member extending outside of the second bollard panel, and placing a panel support between the first bollard panel and the second bollard panel, the panel support comprising an elongated steel member extending perpendicular to the first bollard panel and the second bollard panel, a panel connector located proximate a mid-point of the elongated steel member, an I-beam stub attached to a bottom surface of the elongated steel member proximate the mid-point, wherein a web of the I-beam stub extends parallel to the elongated steel member and flanges of the I-beam stub extend perpendicular to the elongated steel member, and first and second channels formed between the flanges on opposite sides of the web and the elongated steel member, positioning the first end of the first L-shaped member in the first channel, securing the panel connector to the first L-shaped member, positioning the second end of the second L-shaped member in the second channel, and securing the panel connector to the second L-shaped member.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
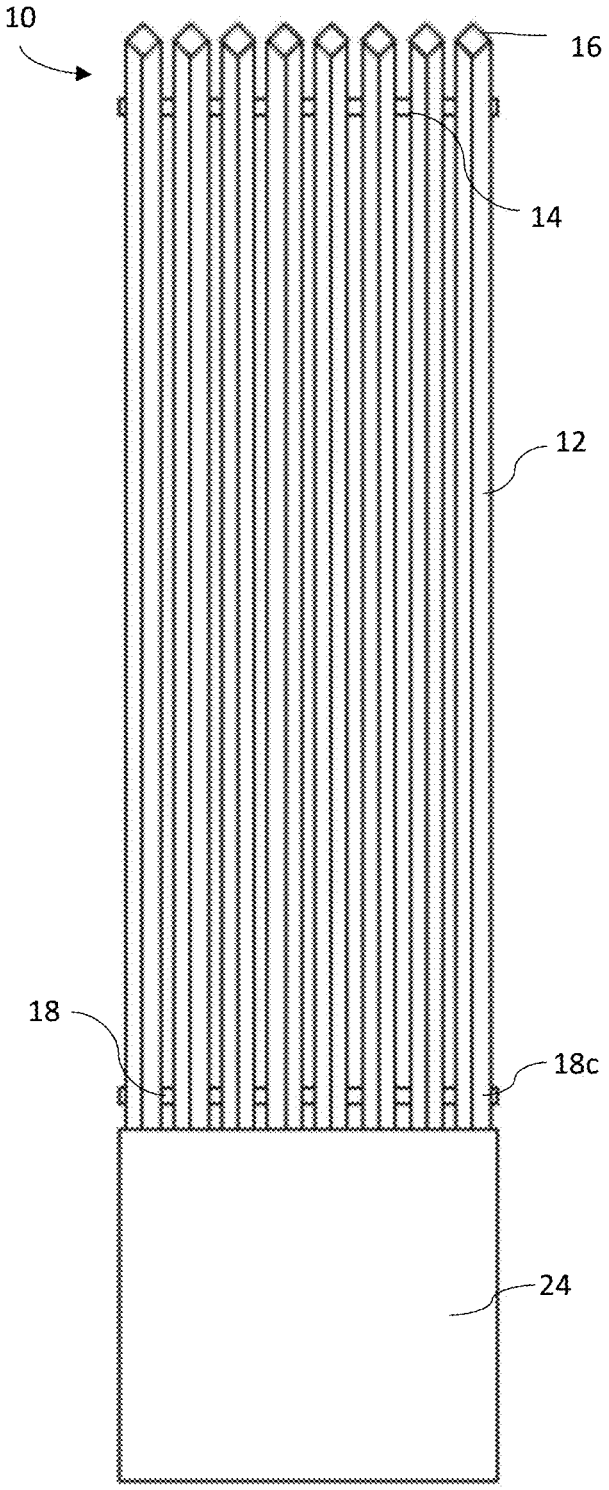
FIG. 1 is a front view of an exemplary bollard wall panel.

It is to be understood that the following disclosure provides many different embodiments, or examples, for implementing different features of various illustrative embodiments. Specific examples of components and arrangements are described below to simplify the disclosure. These are, of course, merely examples and are not intended to be limiting. For example, a figure may illustrate an exemplary embodiment with multiple features or combinations of features that are not required in one or more other embodiments and thus a figure may disclose one or more embodiments that have fewer features or a different combination of features than the illustrated embodiment. Embodiments may include some but not all the features illustrated in a figure and some embodiments may combine features illustrated in one figure with features illustrated in another figure. Therefore, combinations of features disclosed in the following detailed description may not be necessary to practice the teachings in the broadest sense and are instead merely to describe particularly representative examples. In addition, the disclosure may repeat reference numerals and/or letters in the various examples. This repetition is for the purpose of simplicity and clarity and does not itself dictate a relationship between the various embodiments and/or configurations discussed.

Bollard fences may be utilized to provide a security perimeter to prevent or limit the ability of vehicles and pedestrians to enter a protected area. Bollard fences are adapted for use in locations that are not in physical view of security personnel and/or in which the response time for security personnel to respond to an attempted breach is delayed. For example, the bollard fence may be used to protect areas that do not have security personnel on-site and large geographic areas such as airports, rail depots, seaports, manufacturing facilities, refineries, power generation facilities, and national border crossings. Accordingly, various embodiments of the bollard fence are configured to provide protection against ramming by a motor vehicle, to limit penetration by pedestrians, and/or provide anti-tampering features.

Exemplary bollard fences and braces for supporting bollard panels for the purpose of erecting the bollard panels into a bollard fence are described in US 2018/0347227 and U.S. Pat. No. 10,689,819, which are incorporated by reference herein. The bollard panels are not limited to the configurations illustrated herein or those incorporated by reference.

Figure 2:
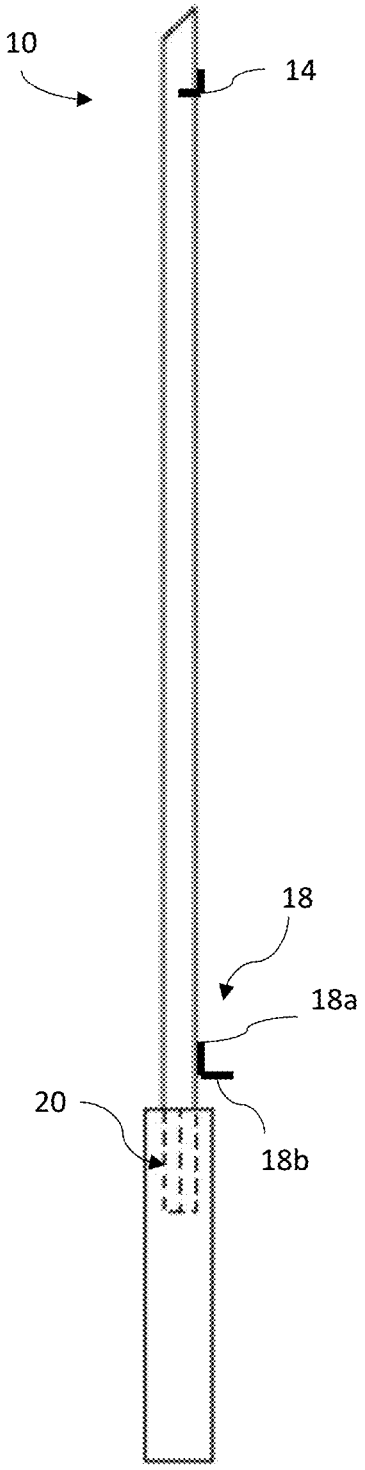
FIG. 2 is a side view of an exemplary bollard wall panel.
Figure 3:
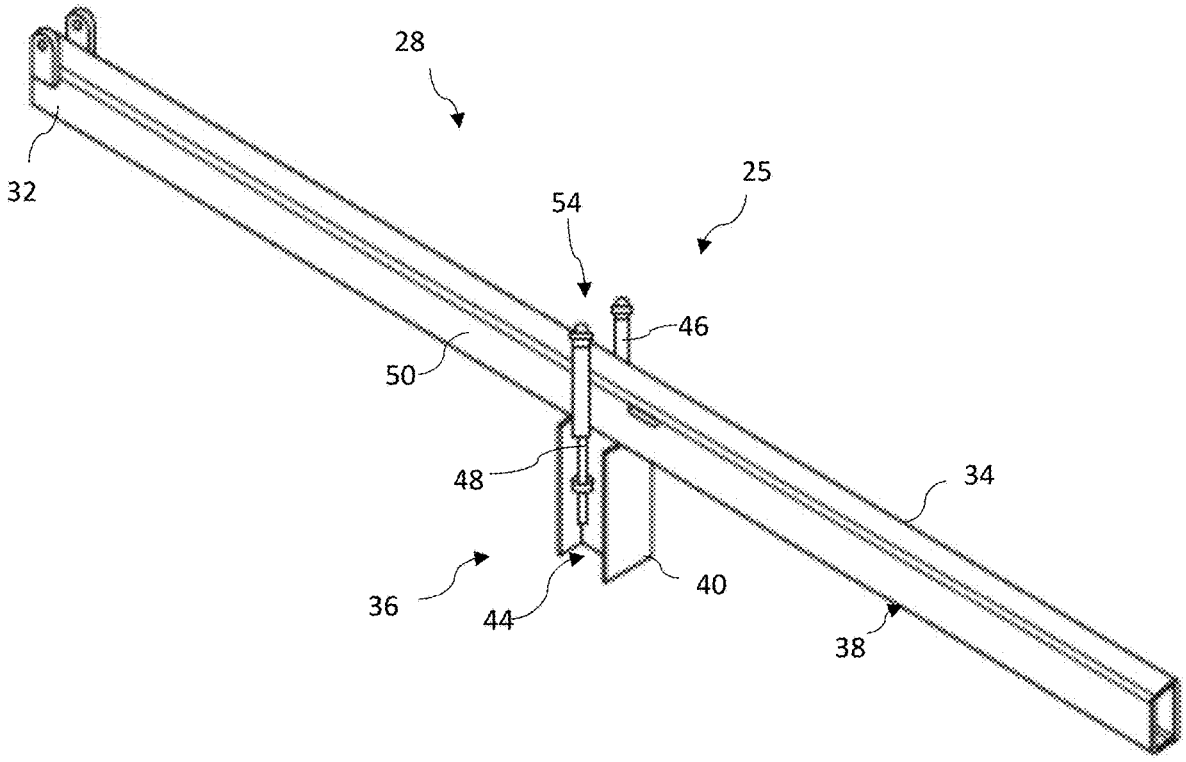
FIG. 3 is a perspective view of an exemplary temporary bollard wall support.

FIGS. 1 and 2 illustrate an exemplary bollard panel 10. The bollard panel 10 includes adjacent bollards 12 (e.g., pipe) extending vertically parallel to one another to form a barrier. An upper structural member 14, shown as angle iron, interconnects the bollards toward the upper end 16 of the bollards and a lower structural member 18, shown as an angle iron, interconnects the bollards toward lower ends 20 of the bollards. The structural members may be constructed of members other than angle iron, for example, a tubular member such as hollow structural steel.

The lower structural member 18 is spaced above the bottom end of the bollards a distance sufficient to be above the ground level 22 when the panels are erected in the ground. FIGS. 1 and 2 illustrate the lower ends of the bollards set in a concrete foundation 24. The concrete foundation may be formed with the panel prior to erecting in the ground or formed with the lower end of the bollard panels set in an excavation 26, see e.g., FIG. 8.

FIGS. 3-6 illustrate views of an exemplary brace 28 for supporting adjacent bollard panels in a vertical position while erecting a bollard fence. For example, the braces support adjacent bollard panels with the lower portion of the panels in an excavation 26 while the panels are set in concrete and/or the excavation is backfilled.

Figure 7:
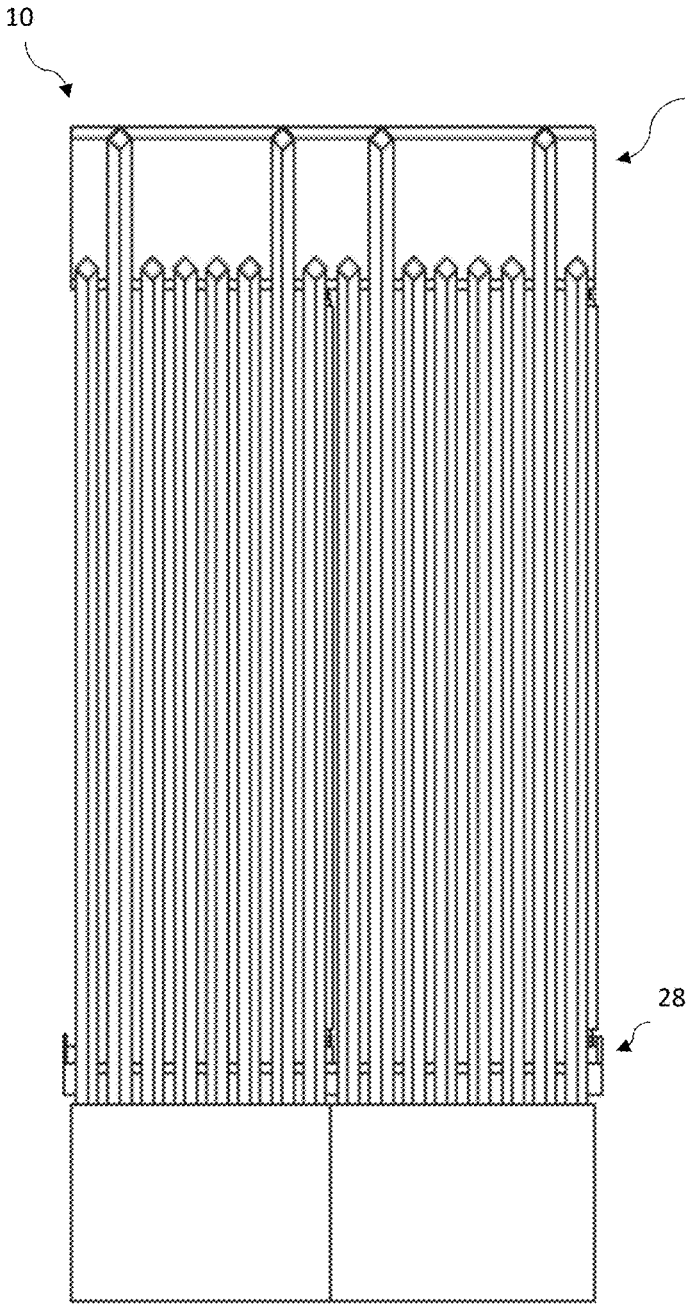
FIG. 7 illustrates adjacent bollard wall panels vertically supported by exemplary temporary bollard wall supports.
Figure 8:
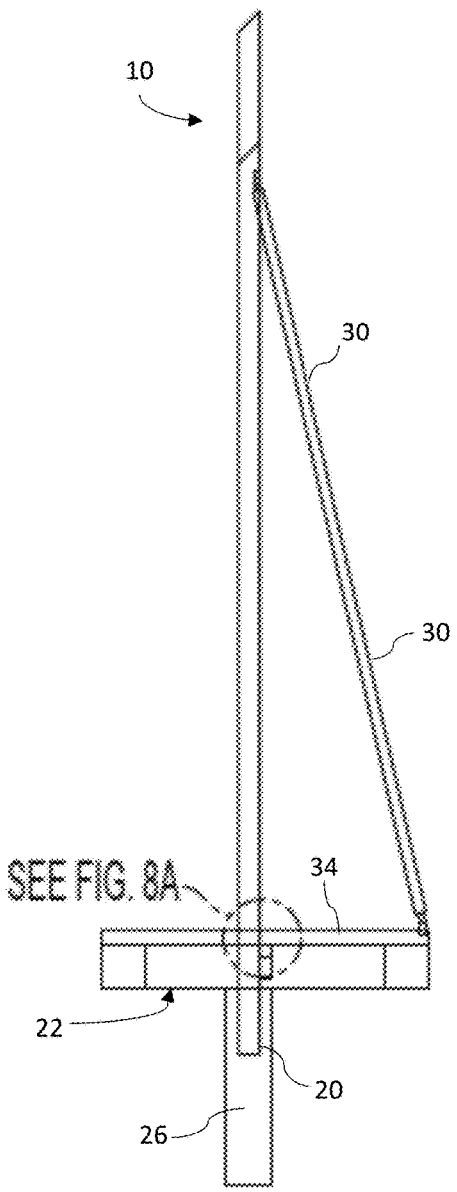
FIG. 8 is a side view illustrating an exemplary temporary bollard wall support holding a bollard wall panel in a vertical position.
Figure 8A:
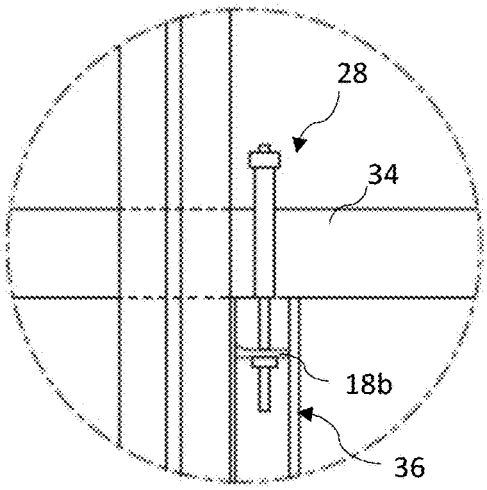
FIG. 8A is a detail view of the connection of the exemplary temporary bollard wall support to the bollard wall panel in FIG. 8.
Figure 9:
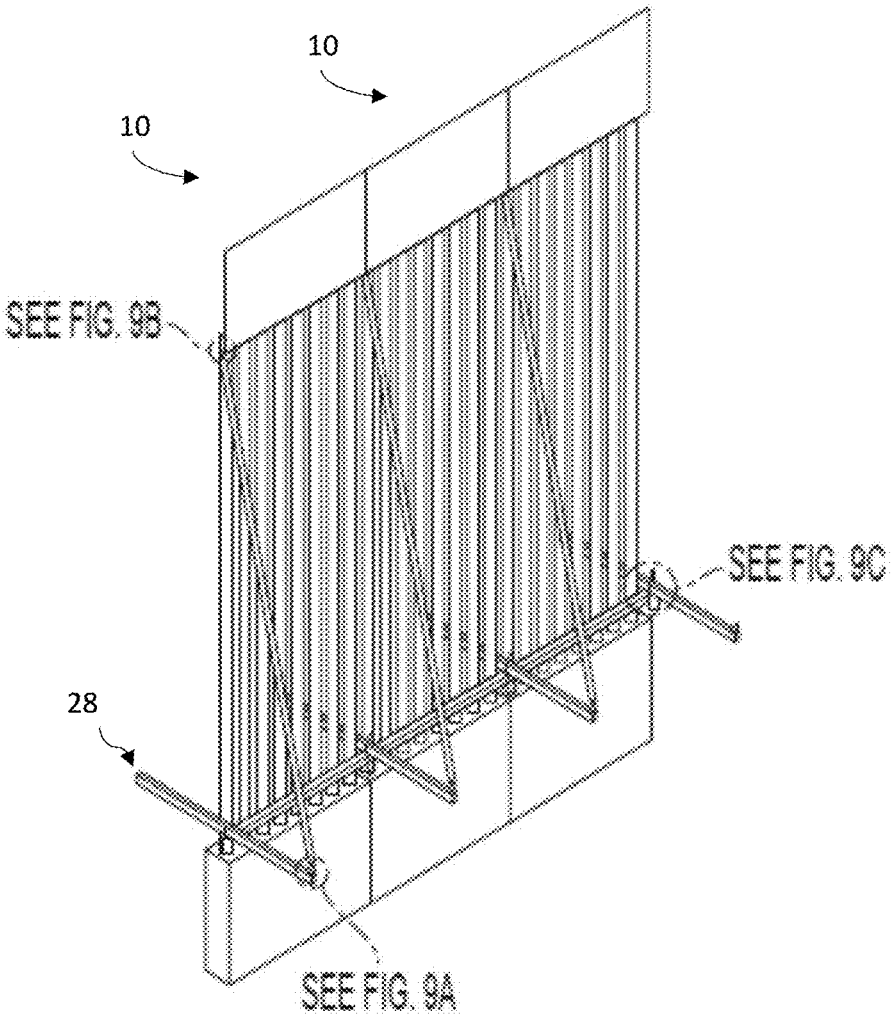
FIG. 9 is a perspective view illustrating temporary bollard wall supports holding adjacent bollard wall panels in a vertical position.
Figure 9A:
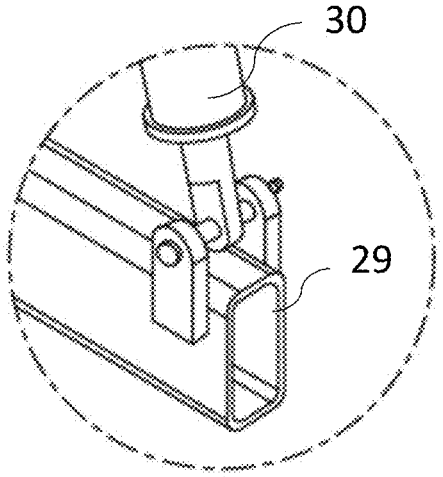
FIG. 9A is a detail view from FIG. 9 illustrating a connection of a diagonal brace to the horizontal support member.
Figure 9B:
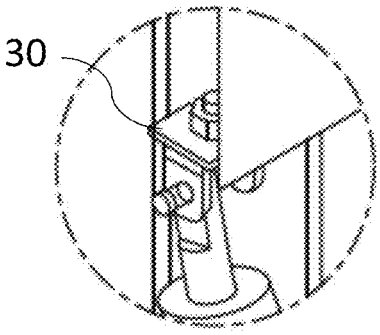
FIG. 9B is a detail view from FIG. 9 illustrating an exemplary connection of the diagonal brace directly to a bollard wall panel.
Figure 9C:
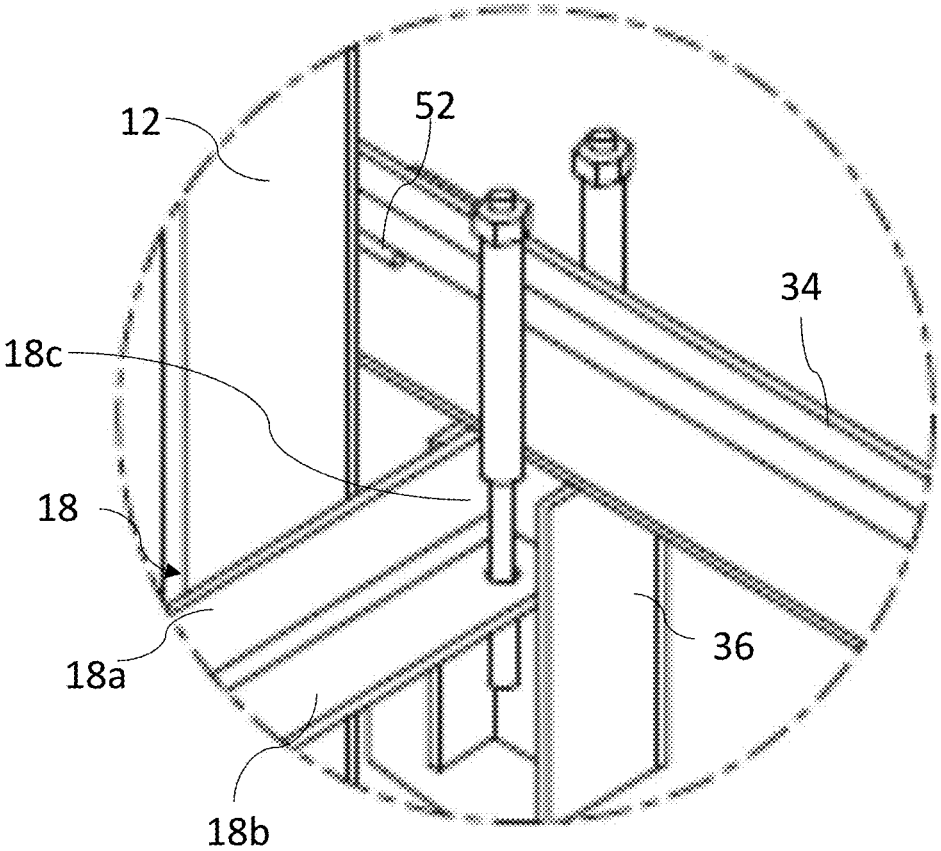
FIG. 9C is a detail view from FIG. 9 illustrating a connection of the temporary bollard wall support to a bollard wall panel.

FIGS. 7, 8 and 9 illustrate views of exemplary braces 28 supporting adjacent panels. The horizontal brace 28 extends between the adjacent panels 10 and is connected to the lower structural member 18 of the adjacent bollard panels as illustrated for example in FIGS. 8A and 9C. A diagonal brace 30 is connected to one end 29 of the horizontal brace 28 (FIG. 9A) and to upper structural member 14 (FIG. 9B) of one of the adjacent panels.

Panel brace 28 comprises an elongated member 34 and a panel connector 25 for securing the elongated member 34 to a horizontal L-shaped structure of a bollard wall panel. In an exemplary embodiment elongated member 34 is a hollow tubular structure. An I-beam shaped stub 36 is attached to a bottom surface 38 of elongated member 34 and extends downward from elongated member 34. Stub 36 is generally normal to elongated member 34. Stub 36 is located proximate a middle section of elongated member 34. Stub 36 has flanges 40 attached by a central web 42 which is oriented parallel to elongated member 34. Channels 44 are formed between flanges 40 on each side of web 42. A tube 46, sized to dispose a bolt 48, is attached, e.g., welded, on each side 50 of elongated member 34 between flanges 40. Tubes 46 extend generally vertically relative to a horizontally extending elongated member 34. Bolts 48 that are positioned in tubes 46 extend into channels 44. Bolts 48 may or may not include threads.

Figure 4:
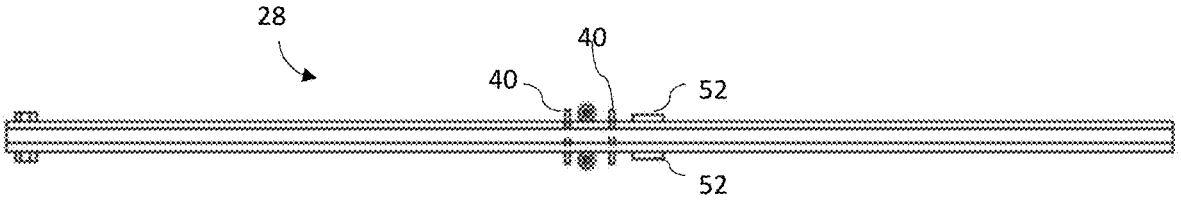
FIG. 4 is a top view of an exemplary temporary bollard wall support.
Figure 5:
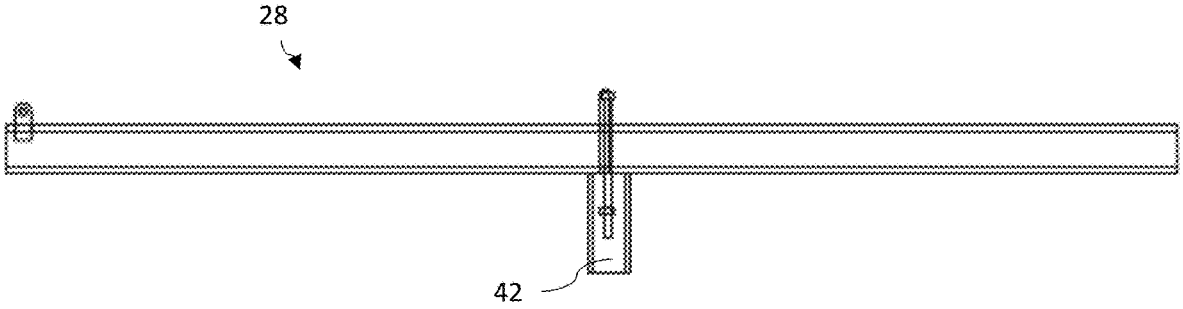
FIG. 5 is a side view of an exemplary temporary bollard wall support.
Figure 6:
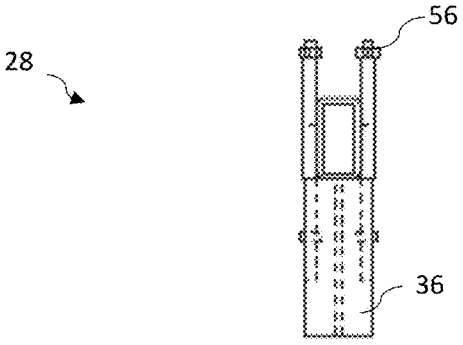
FIG. 6 is an end view of an exemplary temporary bollard wall support.

Panel brace 28 may additionally include a rod 52 attached to sides 50 proximate to stub 36. With reference to FIG. 4, rod 52 is positioned offset from being directly above stub 36.

In an exemplary embodiment, configured for a panel having 6" by 6" bollards and L4" by 4" L-shaped structural member 18, elongated member 34 is a 6" by 3" by 0.375" HSS member having a length of about 10 feet. Tubes 46 are attached to elongated member 34 proximate the mid-point 54 of member 34. Stub 36 is a W5×16 beam having a length of 12". Tubes 46 are one-inch pipe having a length of about 9". Tubes 46 extend about 3" above elongated member 34 in this example. Bolt 48 is a 0.75" diameter coil rod. Nuts 56 may be secured to top and bottom ends 58, 60 of bolt 48. One or more of the nuts 56 may be welded to bolt 48 and/or tube 46. Rod 52 is a 0.5" diameter round bar having a length of approximately 3". Two rods 52 and member 34 have a width of about 4", which is a width between adjacent bollards in an exemplary bollard fence. In this example, rods 52 are positioned approximately 5" axially from tubes 46.

In use, brace 28 is located at the end 5 of a bollard panel, thus between panel ends 5 of adjacent panels 10. Elongated member 34 is oriented perpendicular to panel 10 with bottom surface 38 on the vertical leg 18*a* of the L-shaped panel lower structural member 18. The end 18*c* of L-shaped panel lower structural member 18 is disposed in a channel 44 of stub 36. Bolt 48 extends through the horizontal leg 18*b* of L-shaped panel lower structural member 18. Diagonal brace 30 can be attached to end 32 of elongated member 34 and to panel 10.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include such elements or features. As used herein, the terms "connect," "connection," "connected," "in connection with," and "connecting" may be used to mean in direct connection with or in connection with via one or more elements. Similarly, the terms "couple," "coupling," and "coupled" may be used to mean directly coupled or coupled via one or more elements.

The term "substantially," "approximately," and "about" is defined as largely but not necessarily wholly what is specified (and includes what is specified; e.g., substantially 90 degrees includes 90 degrees and substantially parallel includes parallel), as understood by a person of ordinary skill in the art. The extent to which the description may vary will depend on how great a change can be instituted and still have a person of ordinary skill in the art recognized the modified feature as still having the required characteristics and capabilities of the unmodified feature. In general, but subject to the preceding, a numerical value herein that is modified by a word of approximation such as "substantially," "approximately," and "about" may vary from the stated value, for example, by 0.1, 0.5, 1, 2, 3, 4, 5, 10, or 15 percent.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure and that they may make various changes, substitutions, and alterations without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A method for supporting adjacent bollard fence panels prior to the adjacent bollard panels being secured in the ground, the method comprising:

positioning a first bollard panel with a lower end in an excavation, the first bollard panel comprising first steel bollards arranged in a vertical plane, a first L-shaped member having a first vertical leg and first horizontal leg, the first vertical leg secured to each of the first steel bollards with a first end of the first L-shaped member extending outside of the first bollard panel;

positioning a second bollard panel with a lower end in the excavation, the second bollard panel comprising second steel bollards arranged in the vertical plane, a second L-shaped member having a second vertical leg and second horizontal leg, the second vertical leg secured to each of the second steel bollards with a second end of the second L-shaped member extending outside of the second bollard panel; and placing a panel support between the first bollard panel and the second bollard panel, the panel support comprising an elongated steel member extending perpendicular to the first bollard panel and the second bollard panel, a panel connector located proximate a mid-point of the elongated steel member, an I-beam stub attached to a bottom surface of the elongated steel member proximate the mid-point, wherein a web of the I-beam stub extends parallel to the elongated steel member and flanges of the I-beam stub extend perpendicular to the elongated steel member, and first and second channels formed between the flanges on opposite sides of the web and the elongated steel member;

positioning the first end of the first L-shaped member in the first channel;

securing the panel connector to the first L-shaped member;

positioning the second end of the second L-shaped member in the second channel; and securing the panel connector to the second L-shaped member.

2. The method of claim 1, wherein the panel support is placed at a ground level of the excavation.

3. The method of claim 1, further comprising a diagonal structure connected to an end of the elongated steel member and connected to an upper end of one of the first bollard panel or the second bollard panel.

4. The method of claim 1, wherein the panel connector comprises:

a first tube secured to a first side of the elongated steel member between the flanges and extending perpendicular relative to the bottom surface;

a first bolt mounted in the first tube and extending into the first channel, the first bolt secured to the first L-shaped member;

a second tube secured to a second side of the elongated steel member between the flanges and extending perpendicular relative to the bottom surface; and a second bolt mounted in the second tube and extending into the second channel, the second bolt secured to the second L-shaped member.

5. The method of claim 4, further comprising a diagonal structure connected to an end of the elongated steel member and connected to an upper end of one of the first bollard panel or the second bollard panel.

6. The method of claim 4, wherein:

the first bolt is welded to the first tube; and the second bolt is welded to the second tube.

7. The method of claim 1, wherein:

the first steel bollards and the second steel bollards are 6 inch tubular members;

the first L-shaped member and the second L-shaped member are 4 inch by 4 inch; and the I-beam stub is a W5×16 beam.

8. The method of claim 7, wherein the panel connector comprises:

a first tube secured to a first side of the elongated steel member between the flanges and extending perpendicular relative to the bottom surface;

a first bolt mounted in the first tube and extending into the first channel, the first bolt secured to the first L-shaped member;

a second tube secured to a second side of the elongated steel member between the flanges and extending perpendicular relative to the bottom surface; and a second bolt mounted in the second tube and extending into the second channel, the second bolt secured to the second L-shaped member.

9. The method of claim 8, wherein:

the first and the second tubes are one-inch pipe; and the first bolt and the second bolt are 0.5 inch diameter.

10. The method of claim 8, wherein:

the first bolt is welded to the first tube; and the second bolt is welded to the second tube.

11. The method of claim 8, wherein the panel support is placed at a ground level of the excavation.

12. The method of claim 11, further comprising a diagonal structure connected to an end of the elongated steel member and connected to an upper end of one of the first bollard panel or the second bollard panel.

13. A method for supporting a bollard panel in a vertical position during installation, the method comprising:

positioning a first bollard panel with a bottom end in an excavation, the first bollard panel comprising adjacent bollards interconnected by a first lateral structure with a gap between the adjacent bollards, wherein the first lateral structure has a first end that extends past a first terminal bollard of the first bollard panel;

placing a panel support at ground level of the excavation at the first lateral structure, the panel support comprising a linear structural member extending perpendicular to the first bollard panel with a panel connector at the first lateral structure, an I-beam stub attached to a bottom surface of the linear structural member at the panel connector, wherein a web of the I-beam stub extends parallel to the linear structural member and flanges of the I-beam stub extend perpendicular to the linear structural member, a first channel and a second channel formed between the flanges on opposite sides of the web, and wherein the panel connector comprises a first tube secured to a first side of the linear structural member between the flanges at the first channel, and a second tube secured to a second side of the linear structural member between the flanges at the second channel;

positioning the first end of the first lateral structure in the first channel;

securing the first end of the first lateral structure to the panel support with a first bolt mounted in the first tube and extending into the first end of the first lateral structure in the first channel;

positioning a second bollard panel adjacent to the first bollard panel with a lower end in the excavation, the second bollard panel comprising adjacent bollards interconnected by a second lateral structure with a gap between the adjacent bollards, wherein the second lateral structure has a second end that extends past a second terminal bollard of the second bollard panel;

positioning the second end of the second lateral structure in the second channel; and securing the second end of the second lateral structure to the panel support with a second bolt mounted in the second tube and extending into the second end of the second lateral structure in the second channel.

14. The method of claim 13, further comprising a diagonal structure connected to an end of the linear structural member and connected to an upper end of one of the first bollard panel or the second bollard panel.

15. The method of claim 13, wherein:

the first bolt is welded to the first tube; and the second bolt is welded to the second tube.

16. The method of claim 13, further comprising:

a first rod attached to the first side of the linear structural member proximate to the I-beam stub and offset from being directly aligned with the I-beam stub; and a second rod attached to the second side of the linear structural member opposite the first rod, wherein the first and the second rods extend parallel to the linear structural member.

17. The method of claim 16, wherein:

the first terminal bollard contacts the first rod; and the second terminal bollard contacts the second rod.

18. The method of claim 17, further comprising a diagonal structure connected to an end of the linear structural member and connected to an upper end of one of the first bollard panel or the second bollard panel.

19. The method of claim 17, wherein:

the first bolt is welded to the first tube; and the second bolt is welded to the second tube.

20. The method of claim 19, further comprising a diagonal structure connected to an end of the linear structural member and connected to an upper end of one of the first bollard panel or the second bollard panel.

* * * * *